US006310286B1

(12) United States Patent
Troxel et al.

(10) Patent No.: US 6,310,286 B1
(45) **Date of Patent: *Oct. 30, 2001**

(54) QUAD CABLE CONSTRUCTION FOR IEEE 1394 DATA TRANSMISSION

(75) Inventors: Robert Vincent Troxel, Brea; Jay Edward Cardon, Riverside; Loi Quang Ninh, Foothill Ranch, all of CA (US)

(73) Assignees: Sony Corporation, Tokyo (JP); Sony Trans Com Inc., Irvine, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/014,333

(22) Filed: Jan. 27, 1998

Related U.S. Application Data

(60) Continuation-in-part of application No. 09/300,035, filed on Apr. 27, 1999, which is a division of application No. 08/714,659, filed on Sep. 16, 1996, now Pat. No. 5,945,631.

(60) Provisional application No. 60/039,902, filed on Jan. 29, 1997.

(51) Int. Cl.[7] ..... H01B 11/02

(52) U.S. Cl. ..... 174/36; 174/34; 174/102 R; 174/113 R

(58) Field of Search ..... 174/36, 34, 102 R, 174/102 C, 106 R, 103, 104, 105 R, 107, 35 R, 35 C, 113 R

(56) References Cited

U.S. PATENT DOCUMENTS 2,386,753 10/1945 Shield ..... 174/36

(List continued on next page.)

OTHER PUBLICATIONS

IEEE, "1394–1995 Standard for a High Performance Serial Bus," 1995, USA.

"1394 200 Mb/s Physical Layer Transceiver," IBM Microelectronics, Product Data Sheet and Application Notes, Version 1.4, Mar. 14,1996.

(List continued on next page.)

*Primary Examiner*—Dean A. Reichard
*Assistant Examiner*—William H. Mayo, III
(74) *Attorney, Agent, or Firm*—Haverstock & Owens LLP

(57) ABSTRACT

A quad cable includes four conductors arranged as two differential pairs for carrying the differential signals TPA and TPB. Preferably, the quad cable is used to transmit data signals between devices within an IEEE 1394 network. The two differential conductor pairs are included, with filler material, within a braided inner shield. A shield separator is formed outside of the braided inner shield. A braided outer shield is formed outside of the shield separator. The shield separator provides electrical isolation between the inner and outer shields. A cable jacket is formed outside of the braided outer shield to encase the cable. Each end of the cable includes a cable connector having a plurality of pins for coupling to a receiving connector. The four conductors and the inner shield are each coupled to a respective pin within each cable connector. When coupled to a receiving connector, the outer shield is coupled to a housing of the connector. Within unit electronics at the port housing the receiving connector, a capacitor is preferably coupled between the inner shield and the outer shield. Preferably, the quad cable has a length of 4.5 meters and includes 24 gauge wire for the conductors. Longer, alternate embodiments of the cable incorporate heavier gauge wire for the conductors. Preferably, DC power conductors are not included within the quad cable, but are provided within a separate cable or by each active local device. Alternatively, the DC power conductors are included beside the quad cable within an overall cable jacket.

39 Claims, 4 Drawing Sheets

U.S. PATENT DOCUMENTS

| | | | | |
|---|---|---|---|---|
| 2,603,684 | | 7/1952 | Holmes | 174/106 |
| 3,785,432 | | 1/1974 | Kabat et al. | 165/22 |
| 4,376,920 | | 3/1983 | Smith | 333/12 |
| 4,604,689 | | 8/1986 | Burger | 364/200 |
| 4,761,519 | | 8/1988 | Olson et al. | 174/107 |
| 4,763,360 | | 8/1988 | Daniels et al. | 455/3 |
| 4,822,304 | | 4/1989 | Herron | 439/610 |
| 4,842,366 | | 6/1989 | Sawada et al. | 350/96.3 |
| 4,853,555 | | 8/1989 | Wheat | 307/9.1 |
| 4,871,883 | | 10/1989 | Guiol | 174/36 |
| 4,881,244 | | 11/1989 | Haug | 375/36 |
| 4,924,037 | | 5/1990 | Ainsworth et al. | 174/117 F |
| 4,979,185 | | 12/1990 | Bryans et al. | 375/20 |
| 5,055,064 | | 10/1991 | Imaizumi et al. | 439/402 |
| 5,133,034 | * | 7/1992 | Arroyo et al. | 385/107 |
| 5,162,609 | | 11/1992 | Adriaenssens et al. | 174/34 |
| 5,216,202 | | 6/1993 | Yoshida et al. | 174/36 |
| 5,216,204 | | 6/1993 | Dudek et al. | 174/102 SC |
| 5,244,415 | | 9/1993 | Marsilio et al. | 439/610 |
| 5,362,249 | | 11/1994 | Carter | 439/357 |
| 5,400,340 | | 3/1995 | Hillman et al. | 370/105.3 |
| 5,412,697 | | 5/1995 | Van Brunt et al. | 375/360 |
| 5,418,478 | | 5/1995 | Van Brunt et al. | 326/86 |
| 5,483,656 | | 1/1996 | Oprescu et al. | 395/750 |
| 5,485,458 | | 1/1996 | Oprescu et al. | 370/85.2 |
| 5,485,488 | | 1/1996 | Van Brunt et al. | 375/257 |
| 5,493,657 | | 2/1996 | Van Brunt et al. | 395/308 |
| 5,504,458 | | 4/1996 | Van Brunt et al. | 330/255 |
| 5,504,757 | | 4/1996 | Cook et al. | 370/84 |
| 5,527,996 | | 6/1996 | Ham | 174/113 R |
| 5,572,658 | | 11/1996 | Mohr et al. | 395/182.02 |
| 5,574,250 | * | 11/1996 | Hardie et al. | 174/36 |
| 5,579,486 | | 11/1996 | Oprescu et al. | 395/200.15 |
| 5,592,510 | | 1/1997 | Van Brunt et al. | 375/220 |
| 5,619,544 | | 4/1997 | Lewis et al. | 375/377 |
| 5,781,028 | | 7/1998 | Decuir | 326/30 |
| 5,796,042 | * | 8/1998 | Pope | 174/102 |
| 5,808,660 | | 9/1998 | Sekine et al. | 348/8 |
| 5,881,249 | | 3/1999 | Reasoner | 395/281 |
| 5,945,631 | * | 8/1999 | Henrikson et al. | 174/34 |

OTHER PUBLICATIONS

"IEEE 1394–1995 Triple Cable Transceiver/Arbiter," Texas Instruments TSB21LV03, Product Preview, Revision 0.99, Mar. 19, 1996.

"High Speed Serial Links Benefit From Advanced Cabling" (with figures), Craig Theorin, EDN Access, Oct. 26, 1995.

Tensolite Company product specification, part number 24443/9B048X–4(LD), Jun. 3, 1993.

Tensolite Company product specification, part number 24443/9C062X–4(LD), Mar. 17, 1993.

"P1394 Standard for a High Performance Serial Bus," IEEE P1394 Draft 8.0v2, p. 64, Jul. 7, 1995.

Raychem specification control drawing, part number EPD–RWC–13458, Aug. 7, 1995.

Raychem specification control drawing, part number 82A0111, p. 1 of 2, Sep. 10, 1995.

* cited by examiner

QUAD CABLE CONSTRUCTION FOR IEEE 1394 DATA TRANSMISSION

RELATED APPLICATIONS

This application claims priority under 35 U.S.C. § 119(e) of the co-pending U.S. provisional application Ser. No. 60/039,902 filed on Jan. 29, 1997 and entitled "QUAD CABLE CONSTRUCTION FOR IEEE P1394 DATA TRANSMISSION." The provisional application Ser. No. 60/039,902 filed on Jan. 29, 1997 and entitled "QUAD CABLE CONSTRUCTION FOR IEEE P1394 DATA TRANSMISSION" is also hereby incorporated by reference.

This Patent Application is also a continuation-in-part of the U.S. patent application Ser. No. 09/300,035, filed Apr. 27, 1999, and entitled "IEEE 1394 Active Wall Disconnect and Aircraft Qualified Cable." The Application Ser. No. 09/300,035, filed Apr. 27, 1999, and entitled "IEEE 1394 Active Wall Disconnect and Aircraft Qualified Cable" is a Divisional Application of the U.S. patent application Ser. No. 08/714,659, filed on Sep. 16, 1996, and entitled "IEEE 1394 Active Wall Disconnect and Aircraft Qualified Cable", which is now issued as U.S. Pat. No. 5,945,631. The Application Ser. No. 09/300,035, filed Apr. 27, 1999, and entitled "IEEE 1394 Active Wall Disconnect and Aircraft Qualified Cable" and the U.S. Pat. 5,945,631, issued on Aug. 31, 1999, entitled "IEEE 1394 Active Wall Disconnect and Aircraft Qualified Cable" are both, hereby incorporated by reference.

FIELD OF THE INVENTION

The present invention relates to the field of network cabling. More particularly, the present invention relates to the field of network cabling for use with an IEEE 1394 serial bus network.

BACKGROUND OF THE INVENTION

The IEEE 1394 standard, "P1394 Standard For A High Performance Serial Bus," Draft 8.01v1, Jun. 16, 1995, is an international standard for implementing an inexpensive high-speed serial bus architecture which supports both asynchronous and isochronous format data transfers. The IEEE 1394 standard provides a high-speed serial bus for interconnecting digital devices thereby providing a universal I/O connection. The IEEE 1394 standard defines a digital interface for the applications thereby eliminating the need for an application to convert digital data to analog data before it is transmitted across the bus. Correspondingly, a receiving application will receive digital data from the bus, not analog data, and will therefore not be required to convert analog data to digital data. An 'application' as used herein will refer to either an application or a device driver.

The cable specified by the IEEE 1394 standard is very thin in size compared to many other cables, such as conventional co-axial cables, used to connect such devices. Devices can be added and removed from an IEEE 1394 bus while the bus is active. If a device is so added or removed the bus will then automatically reconfigure itself for transmitting data between the then existing nodes. A node is considered a logical entity with a unique address on the bus structure. Each node provides an identification ROM, a standardized set of control registers and its own address space.

A standard IEEE 1394 cable is illustrated in FIG. 1. An IEEE 1394 network using the standard IEEE 1394 cable 10 is a differential, copper wire network, which includes two differential pairs of wires 12 and 14, carrying the differential signals TPA and TPB, respectively. As shown in FIG. 1, the pairs of wires 12 and 14 are twisted together within the cable 10. The signals TPA and TPB are both low voltage, low current, bidirectional differential signals used to carry data bits or arbitration signals. The signals TPA and TPB have a maximum specified amplitude of 265 mVolts. The twisted pairs of wires 12 and 14 have a relatively high impedance, specified at 110 ohms, such that minimal power is needed to drive an adequate signal across the wires 12 and 14. The standard IEEE 1394 cable 10 also includes a pair of power signals VG and VP, carried on the wires 16 and 18, respectively. The wires 16 and 18 are also twisted together within the cable 10. The pair of power signals VP and VG provide the current needed by the physical layer of the serial bus to repeat signals. The wires 16 and 18 have a relatively low impedance and are specified to have a maximum power level of 60 watts.

The IEEE 1394 cable environment is a network of nodes connected by point-to-point links, including a port on each node's physical connection and the cable between them. The physical topology for the cable environment of an IEEE 1394 serial bus is a non-cyclic network of multiple ports, with finite branches. The primary restriction on the cable enviromnment is that nodes must be connected together without forming any closed loops.

The IEEE 1394 cable connects ports together on different nodes. Each port includes terminators, transceivers and simple logic. A node can have multiple ports at its physical connection. The cable and ports act as bus repeaters between the nodes to simulate a single logical bus. Because each node must continuously repeat bus signals, the separate power VP wire 18 and ground VG wire 16, within the cable 10, enable the physical layer of each node to remain operational even when the local power at the node is turned off. The pair of power wires 16 and 18 can even be used to power an entire node if it has modest power requirements. The signal VG carried on the wire 16 is a grounded signal. The signal VP carried on the wire 18 is powered from local power of the active devices on the IEEE 1394 serial bus. Accordingly, at least one of the active devices must be powered by local power. Together, the signals VG and VP form a power signal which is used by the nodes.

A maximum cable length of 4.5 meters is specified for an IEEE 1394 cable. The cabling limitations of an IEEE 1394 serial bus are set by the timing requirements and signal waveform characteristics for transmitted signals. The default timing is set after at most two bus resets, and it is adequate for 32 cable hops, each of 4.5 meters, for a total of 144 meters. This maximum cable length is not practical in some environments in which the distance between active devices is greater than 4.5 meters. One such environment is within an aircraft which can require cable lengths well over 4.5 meters.

U.S. patent application Ser. No. 08/714,659, entitled "IEEE 1394 ACTIVE WALL DISCONNECT AND AIRCRAFT QUALIFIED CABLE" and filed on Sep. 16, 1996, which is hereby incorporated by reference, teaches an IEEE 1394 cable having a length greater than 4.5 meters. The longer cable lengths taught in this application incorporate heavier gauge wire for the two twisted data pairs 12 and 14 in order to match the performance characteristics of a standard IEEE 1394 cable and comply with the signal levels and timing requirements of the IEEE 1394 specification over the increased distance. U.S. patent application Ser. No. 08/714,659 teaches an IEEE 1394 cable having a length of 20 meters including twisted pairs of wire of 18 gauge wire and an IEEE 1394 cable having a length of 30 meters including twisted pairs of wire of 16 gauge wire. While the cables taught in U.S. patent application Ser. No. 08/714,659 achieve longer cable lengths than 4.5 meters and still perform according to the appropriate parameters set by the IEEE 1394 specification, the cables are large in diameter, due to the heavier gauge wire used to achieve the longer length and the thick dielectric material required to maintain signal characteristics. When wiring within a closed environment such as an aircraft where space taken up by the cable is a consideration, large diameter cables are disadvantageous and present problems in assembling and routing the cables. The large diameter cables also add extra weight to the aircraft.

What is needed is a cable for use between IEEE 1394 devices which has a length greater than 4.5 meters and a relatively small diameter and minimum weight.

SUMMARY OF THE INVENTION

A quad cable includes four conductors arranged as two differential pairs for carrying the differential signals TPA and TPB. Preferably, the quad cable is used to transmit data signals between devices within an IEEE 1394 network. The two differential conductor pairs are included, with filler material, within a braided inner shield. A shield separator is formed outside of the braided inner shield. A braided outer shield is formed outside of the shield separator. The shield separator provides electrical isolation between the inner and outer shields. A cable jacket is formed outside of the braided outer shield to encase the cable. Each end of the cable includes a cable connector having a plurality of pins for coupling to a receiving connector. The four conductors and the inner shield are each coupled to a respective pin within each cable connector. When coupled to a receiving connector, the outer shield is coupled to a housing of the connector. Within unit electronics at the port housing the receiving connector, a capacitor is preferably coupled between the inner shield and the outer shield. Preferably, the quad cable has a length of 4.5 meters and includes 24 gauge wire for the conductors. Longer, alternate embodiments of the cable incorporate heavier gauge wire for the conductors. Preferably, DC power conductors are not included within the quad cable, but are provided within a separate cable or by each active local device. Alternatively, the DC power conductors are included beside the quad cable within an overall cable jacket.

DETAILED DESCRIPTION OF THE PREFERRED EMBODIMENT

A quad cable of the present invention includes four conductors arranged as two differential pairs for carrying the differential signals TPA and TPB between IEEE 1394 devices. Preferably, the quad cable is used to transmit data signals between devices within an IEEE 1394 network. Alternatively, the quad cable can be used to transmit signals within an IEEE 1394 network or within another serial bus network. The two differential conductor pairs are included, with filler material, within a braided inner shield. A shield separator is formed outside of the braided inner shield. A braided outer shield is formed outside of the shield separator. The shield separator provides electrical isolation between the inner and outer shields and preferably includes an aluminum layer for improved high frequency shielding. Preferably, a no smoke, no halogen, flame retardant cable jacket is formed outside of the braided outer shield to encase the cable. Each end of the cable includes a cable connector having a plurality of pins for coupling to a receiving connector at a device or a repeater.

The four conductors and the inner shield are each coupled to a respective pin within the cable connectors. When the cable connector is coupled to a receiving connector, the outer shield is coupled to a housing of the connector. Within unit electronics at the port housing the receiving connector, a capacitor is preferably coupled between the inner shield and the outer shield in order to properly maintain electrical isolation between the inner and outer shields. Preferably, the quad cable has a length of 4.5 meters and includes 24 gauge wire for the conductors. Longer, alternate embodiments of the cable incorporate heavier gauge wire for the conductors. Preferably, DC power conductors are not included within the quad cable, but are provided within a separate cable or by each active local device. Alternatively, the DC power conductors are included beside the quad cable within an overall cable jacket.

Generally, quad cable includes four parallel conductors all enclosed within an outer shield. Quad cable is constructed such that each conductor of a differential signal pair is geometrically opposite to the other conductor in the same pair. Within the quad cable, the two differential pairs are perpendicular to one another with a common central axis. This geometric orientation of the two differential pairs within the quad cable minimizes coupling and crosstalk between the two pairs. Within the differential pairs, the differential signal transmission increases achievable common-mode rejection and signal-to-noise ratio and reduces ground bounce and the effects of electromagnetic interference.

Figure 1:
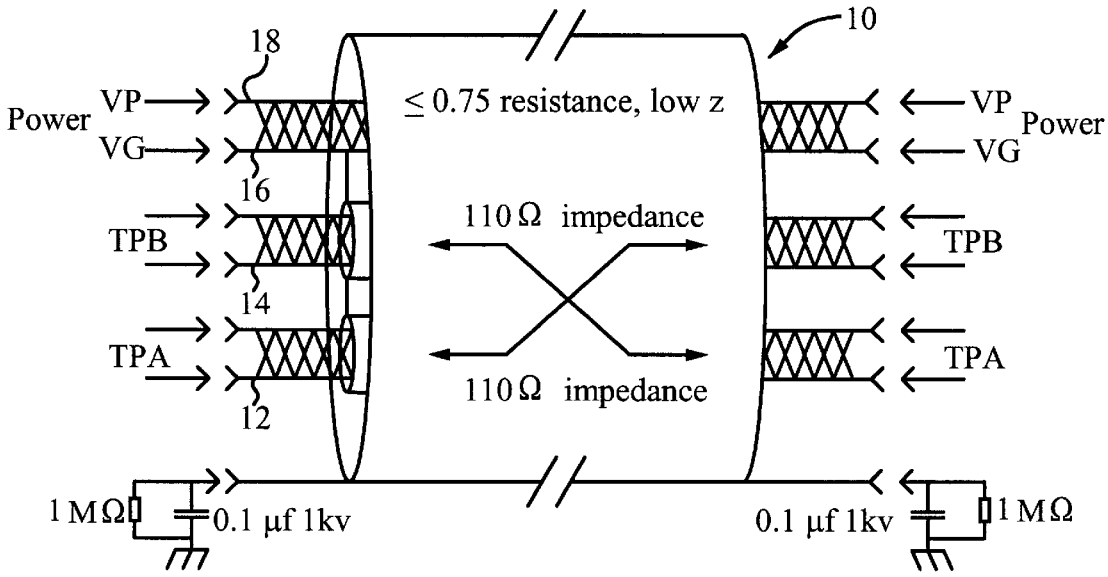
Fig. 1 (PRIOR ART)
FIG. 1 illustrates a standard IEEE 1394 cable of the prior art.
Figure 2:
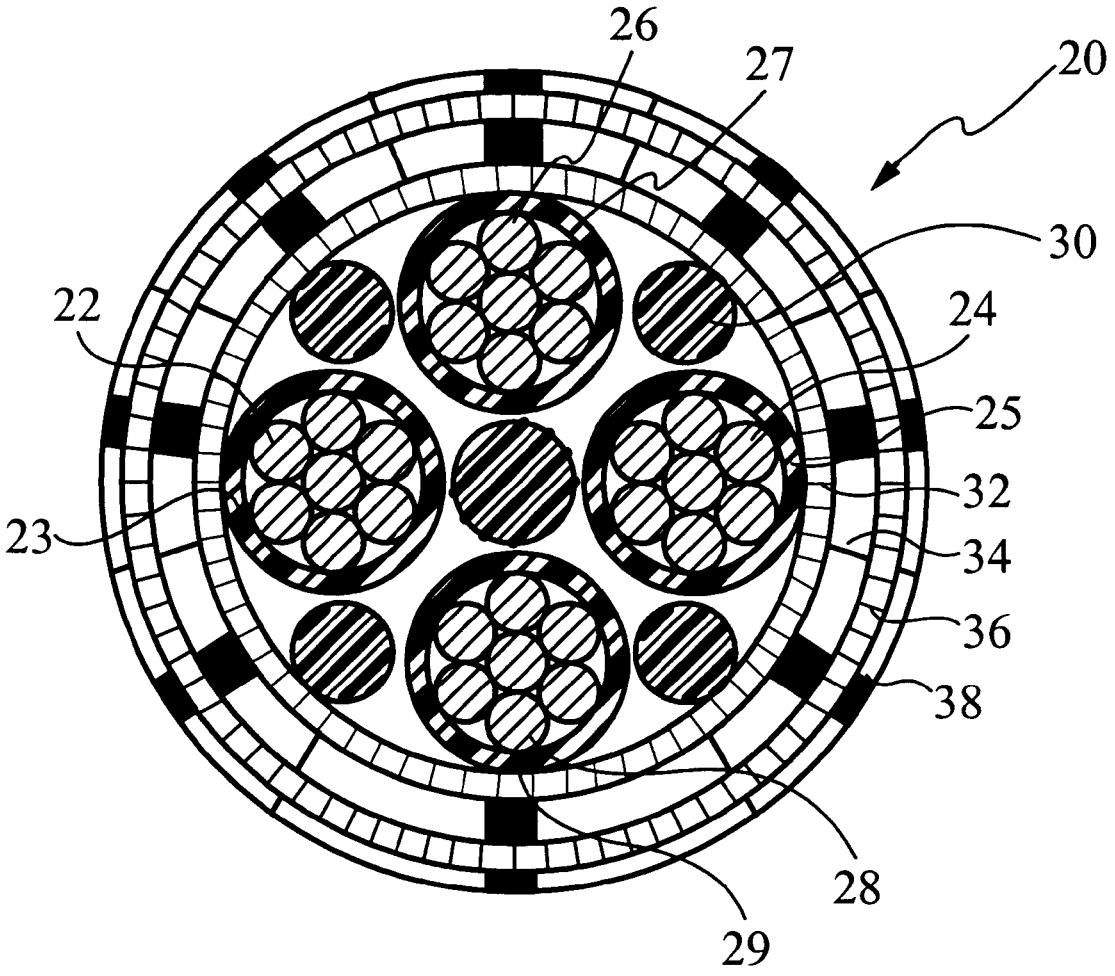
FIG. 2 illustrates a cross section of an IEEE 1394 quad cable of the preferred embodiment of She present invention.

A quad cable for transmitting data between devices within an IEEE 1394 serial bus network, according to the preferred embodiment of the present invention, is illustrated in FIG. 2. The quad cable 20 includes two differential pairs of conductors for transmitting signals between IEEE 1394 nodes or repeaters. The conductors 22 and 24 form a first differential pair for carrying the differential signal TPA. The conductors 26 and 28 form a second differential pair for carrying the differential signal TPB. Each of the conductors 22, 24, 26 and 28 have an associated conductor jacket 23, 25, 27 and 29, respectively, used to enclose and encase each conductor. The filler material 30 is constructed and positioned to maintain the relative perpendicular orientation of the signal pairs. Within the preferred embodiment of the present invention, the composition and size of the filler material 30 and the conductor jackets 23, 25, 27 and 29 is appropriate to provide a characteristic impedance of 110 ohms ±6 ohms, as measured across the two conductors of each signal pair.

The two differential pairs formed from the conductors 22, 24, 26 and 28 and the filler material 30 are encased within a braided inner shield 32. A shield separator 34 is formed around the inner shield 32. An overall braided outer shield 36 is formed around the shield separator 34. The shield separator 34 provides electrical isolation between the inner shield 32 and the outer shield 36 and includes an aluminum layer to provide additional high frequency shielding. This three layer shield configuration provides improved limitation of EMI emissions and susceptibility. A jacket 38 is formed around the braided outer shield 36. This jacket 38 is preferably a no smoke, no halogen, flame retardant jacket 38. This no smoke, no halogen, flame retardant jacket 38 is provided in order to comply with the Federal Aviation Administration Regulation regarding the required fire protection of systems, in order to use this cable on commercial aircraft. 14 C.F.R. §25.869 (1994).

Embodiments of the IEEE 1394 quad cable of the present invention have been designed to have different lengths. The cable 20 of the preferred embodiment of the present invention has a length of 4.5 meters to comply with the IEEE 1394 standard specification. However, alternate embodiments of the cable of the present invention have longer lengths for spanning distances greater than 4.5 meters. The IEEE 1394 cable of the present invention is preferably for use on board a commercial aircraft to couple and form an IEEE 1394 serial bus network between devices which are part of an in-flight entertainment system, as taught in U.S. patent application Ser. No. 08/714,772, filed on Sep. 16, 1996, and entitled "Combined Digital Audio/Video On Demand And Broadcast Distribution System," which is hereby incorporated by reference. Because of the constraints of this system and of the limited space available within the aircraft, a cable having a length greater than 4.5 meters is necessary for coupling between some of the devices within the system.

While the preferred use of the cable of the present invention is within an aircraft, it should be apparent that the cables according to the present invention can be used in other environments in which the standard IEEE 1394 cable is not appropriate, including other transportation vehicles such as trains, busses, ferries and cruise ships. Specifically, the cable of the present invention is suitable for use in any environment where a thinner diameter IEEE 1394 cable is necessary.

The cable 20 of the preferred embodiment, illustrated in FIG. 2, has a length of 4.5 meters. The conductors 22, 24, 26 and 28 are each preferably 24 AWG (American Wire Gauge) silver tinned copper wires. Each conductor 22, 24, 26 and 28 includes its own separate insulation which is preferably expanded PTFE. Each conductor 22, 24, 26 and 28 and its corresponding insulation are encased by a respective jacket 23, 25, 27 and 29. The filler material 30 is preferably expanded PTFE and is used to maintain the relative perpendicular orientation of the differential pairs of the conductors. Alternatively, the filler material 30 can be any other appropriate non-conductive material. The inner shield 32 and the outer shield 36 are preferably braided shields constructed of tin coated copper braid material. Alternatively, any appropriate shield material can be used. The shield separator 34 is preferably constructed of foil-free edge aluminum/polyester tape used for electrical isolation between the inner and outer shields and to provide additional high frequency shielding. Alternatively, any appropriate non-conducting, dielectric insulating tape can be used. The jacket 38 is preferably constructed of extruded FEP. The differential pairs of conductors preferably have a characteristic differential impedance of 110 ohms, per the IEEE 1394 specification.

In order to simulate the other requirements of the IEEE 1394 specification, the longer length cables of the alternate embodiments of the present invention incorporate heavier gauge wire for the conductors 22, 24, 26 and 28 used to carry the differential signals TPA and TPB. Specifically, for lengths of cable up to 15 meters, the conductors 22, 24, 26 and 28 are 20 gauge silver tinned copper wires. For lengths of cable up to 25 meters, the conductors 22, 24, 26 and 28 are 18 gauge silver tinned copper wires. The heavier gauge wire ensures that the strength of these signals is not degraded and that attenuation is limited to meet performance requirements over the entire length of the longer cable. However, the heavier gauge wire also increases the diameter of the cables having longer lengths. The other materials, characteristics and properties of the cable are preferably identical between the cables of different lengths.

Figure 3:
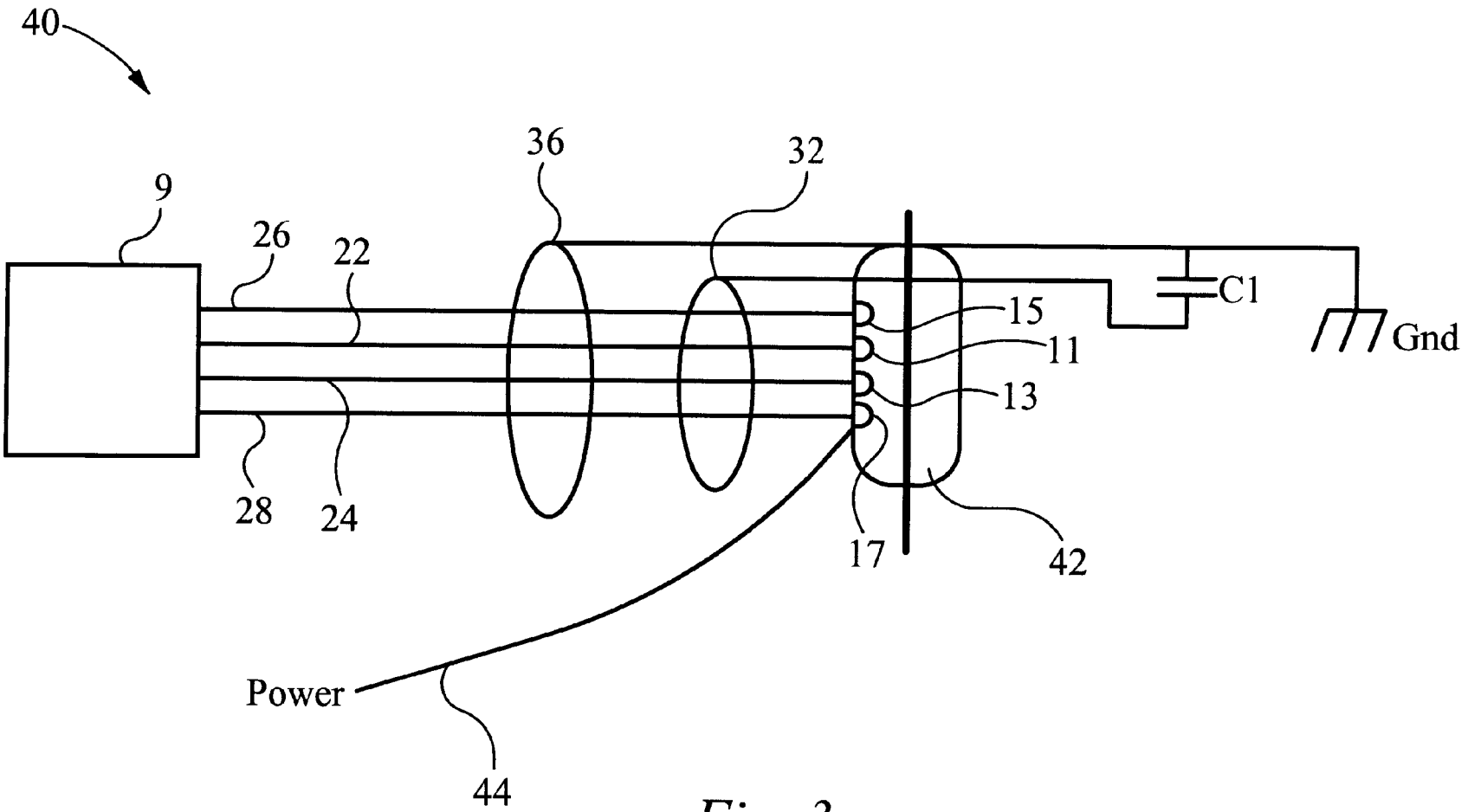
FIG. 3 illustrates a block diagram of the assembly and connection of the quad cable of the present invention.

A block diagram of the system 40 with the quad cable 20 of the present invention is illustrated in FIG. 3. For simplicity, one end of the system 40 is depicted with detail in the FIG. 3. It is understood that there is a second end 9 of the system 40 with pins and a connector such as those illustrated in the FIG. 3 and described in detailed. The cable 20 is shown connected to a receiving connector 42 which can either be at a port within a device or a repeater. The receiving connector 42 is coupled to appropriate unit electronics at the port within the device or repeater housing the receiving connector. The cable connector at the end of the cable 20 is plugged into the receiving connector 42 in a known manner. The conductors 22, 24, 26 and 28 are coupled to appropriate pins 11, 13, 15 and 17 located within the cable connector which correspond to pin receivers within the receiving connector 42. The inner shield 32 which encloses all four of the signal conductors 22, 24, 26 and 28 is also coupled to a pin 19 located within the cable connector. The outer shield 36 which encloses all four of the signal conductors 22, 24, 26 and 28 and the inner shield 32, is coupled to ground through the connector housing, when the cable 20 is connected to the receiving connector 42. Within the unit electronics at the port housing the receiving connector 42, a capacitor C1 is preferably coupled between the inner shield 32 and the outer shield 36 in order to AC couple the inner shield 32 and the outer shield 36 and properly maintain electrical isolation between the shields 32 and 36.

As discussed above, the IEEE 1394 specification requires that the power signals VP and VG are carried on wires within the cable. However, in the preferred embodiment of the present invention, the cable 20 only includes the conductors 22, 24, 26 and 28 and does not include any DC power conductors. Within the preferred embodiment of the present invention, DC power is provided separately to the devices within the IEEE 1394 network, outside of the cable 20. The DC power is either provided locally by each active device or by a separate power cable 44, as illustrated in FIG. 3.

Figure 4:
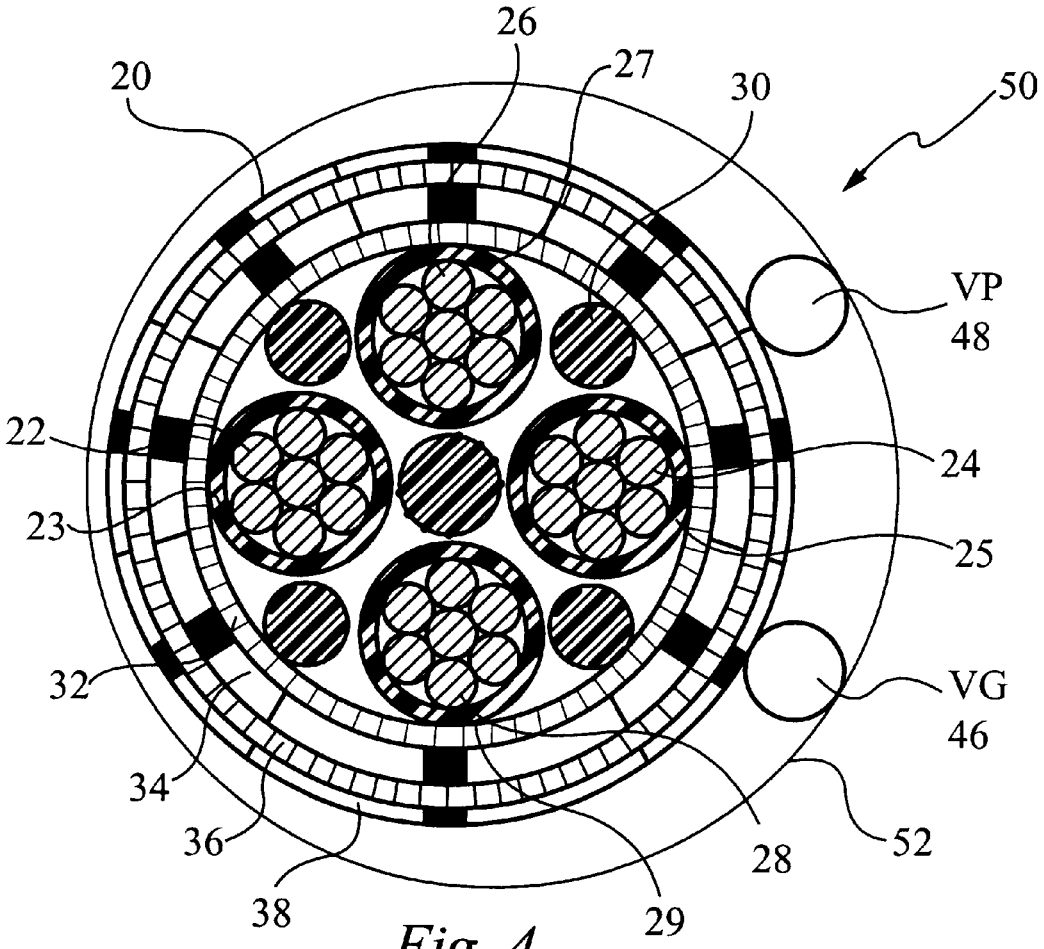
FIG. 4 illustrates a cross section of a cable of an alternate embodiment including an IEEE 1394 quad cable and DC power conductors.

Alternatively, as illustrated in FIG. 4, the cable 50 includes a quad cable 20 and a separate power VP wire 48 and ground VG wire 46 enclosed within an overall cable jacket 52. The components within the quad cable 20 are identical to the components of the cable illustrated in FIG. 2 and discussed above. The power VP wire 48 and ground VG wire 46 are encased between the quad cable 20 assembly and the overall cable jacket 52. Because of the addition of the separate power VP wire 48 and ground VG wire 46, the diameter of the cable 50 is greater than the diameter of the cable 20.

In Table 1, below, the diameter and weight of a 20 meter shielded twisted pair cable, as taught in U.S. patent application Ser. No. 08/714,659, referred to above, is compared to a 20 meter quad cable constructed according to the preferred embodiment of the present invention. Each of the cables use 20 gauge wire. For this comparison, the weight of the DC conductors within the shielded twisted pair cable was subtracted from the total weight of the cable since the quad cable of the preferred embodiment does not include the DC power conductors.

TABLE 1

Comparison of Cable Diameter and Weight

| IEEE 1394 CABLE TYPE | OUTER DIAMETER | WEIGHT per 1000 feet |
|---|---|---|
| STP (18 AWG) | 0.75 inches | 184.9 pounds |
| Quad (18 AWG) | 0.285 inches | 66.5 pounds |

As illustrated by Table 1, a 20 meter quad cable constructed according to the preferred embodiment of the present invention is much smaller and lighter than the shielded twisted pair cable.

Within the quad cable of the preferred embodiment of the present invention, the conductors 22, 24, 26 and 28 have a characteristic impedance of 110 ohms ±6 ohms, per the IEEE 1394 specification. However, within an alternate embodiment of the present invention, the conductors 22, 24, 26 and 28 have a characteristic impedance of 105 ohms ±5 ohms. This lower characteristic impedance allows the quad cable of the present invention to be used within an IEEE 1394 serial bus network or to provide data transmission for serial busses other than the IEEE 1394 serial bus, if the network is not an IEEE 1394 network. Other serial busses typically have a characteristic impedance of 100 ohms ±10 ohms. When wiring an aircraft or other vehicle or building, it is desirable to include a single set of cables which can be used for data transmission between devices no matter what type of serial bus is implemented. Otherwise, multiple cables would have to be run for different networks of devices. Accordingly, the quad cable of this alternate embodiment includes a characteristic impedance of 105 ohms ±5 ohms. Therefore, the quad cable of the present invention, while intended for use within IEEE 1394 serial bus networks, can also be used between devices within other types of serial bus networks.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

We claim:

1. A system comprising a quad cable greater than 4.5 meters in length for use within an IEEE 1394 serial bus network, the cable comprising:

a. a first pair of differential conductors arranged parallel to each other over a length of the quad cable;

b. a second pair of differential conductors arranged parallel to each other over the length of the quad cable;

c. an inner braided shield formed around the first and second pair of differential conductors;

d. an outer braided shield formed around the first and second pair of differential conductors and the inner braided shield;

e. a shield separator positioned between the inner braided shield and the outer braided shield for maintaining electrical isolation between the inner braided shield and the outer braided shield; and f. a flame retardant jacket formed around the outer braided shield.

2. The system as claimed in claim 1, further comprising a first cable connector at a first end of the cable and a second cable connector at a second end of the cable, the first and second cable connectors each including a first and second pin coupled to the first pair of differential conductors and a third and fourth pin coupled to the second pair of differential conductors.

3. The system as claimed in claim 2, wherein the first and second cable connectors are for coupling to a receiving connector including a plurality of pin receivers and a housing, wherein the receiving connector includes first, second, third and fourth pin receivers for receiving and electrically coupling to the first, second, third and fourth pins.

4. The system as claimed in claim 3, wherein the first and second cable connectors further include a fifth pin coupled to the inner shield and the receiving connector includes a corresponding fifth pin receiver for receiving and electrically coupling to the fifth pin.

5. The system as claimed in claim 4, wherein the outer braided shield is coupled to the connector housing.

6. The system as claimed in claim 5, wherein the receiving connector further includes a capacitor coupled between the connector housing and the fifth pin receiver.

7. The system as claimed in claim 6, wherein the first and second differential pair of conductors have a characteristic impedance less than 110 ohms for also transmitting data between non IEEE 1394 devices.

8. A system comprising an IEEE 1394 quad cable greater than 4.5 meters in length, the cable comprising:

a. a first pair of differential conductors arranged parallel to each other over a length of the quad cable for carrying differential signals between IEEE 1394 devices; and b. a second pair of differential conductors arranged parallel to each other over the length of the quad cable for carrying differential signals between IEEE 1394 devices.

9. The system as claimed in claim 8, further comprising a first connector at a first end of the cable and a second connector at a second end of the cable, the first and second connectors each including a first and second pin coupled to the first pair of differential conductors and a third and fourth pin coupled to the second pair of differential conductors.

10. The system as claimed in claim 9, further comprising an inner shield formed around the first and second pair of differential conductors.

11. The system as claimed in claim 10, further comprising an outer shield formed around the first and second pair of differential conductors and the inner shield.

12. The system as claimed in claim 11, further comprising a shield separator positioned between the inner shield and the outer shield for maintaining electrical isolation between the inner and outer shields.

13. The system as claimed in claim 12, further comprising a receiver connector comprising a connector housing, wherein the inner braided shield and the outer braided shield are coupled to ground through the connector housing.

14. The system as claimed in claim 13, wherein the receiver connector further comprises a capacitor through which the inner braided shield and the outer braided shield are AC coupled.

15. The system as claimed in claim 12, wherein the shield separator comprises aluminum.

16. The system as claimed in claim 12, wherein the shield separator comprises an aluminum layer.

17. The system as claimed in claim 12, further comprising a jacket formed around the outer shield.

18. The system as claimed in claim 17, wherein the inner and outer shields are both braided shields.

19. The system as claimed in claim 18, wherein the jacket is flame retardant.

20. The system as claimed in claim 8, wherein each differential conductor from the first pair of differential conductors are positioned opposite of each other through a center of the cable and each differential conductor from the second pair of differential conductors are positioned opposite of each other through the center of the cable.

21. A system comprising a quad cable greater than 4.5 meters in length for use within an IEEE 1394 serial bus network, the cable comprising:

a. a first pair of differential conductors arranged parallel to each other over a length of the quad cable;

b. a second pair of differential conductors arranged parallel to each other over the length of the quad cable;

c. an inner braided shield formed around the first and second pair of differential conductors;

d. an outer braided shield formed around the first and second pair of differential conductors and the inner braided shield; and e. a jacket formed around the outer braided shield.

22. The system as claimed in claim 21, further comprising a first cable connector at a first end of the cable and a second cable connector at a second end of the cable, the first and second cable connectors each including a first and second pin coupled to the first pair of differential conductors and a third and fourth pin coupled to the second pair of differential conductors.

23. The system as claimed in claim 22, wherein the first and second cable connectors are for coupling to a receiving connector including a plurality of pin receivers and a housing, wherein the receiving connector includes a first, second, third and fourth pin receiver for receiving and electrically coupling to the first, second, third and fourth pins.

24. The system as claimed in claim 23, wherein the first and second cable connectors further include a fifth pin coupled to the inner shield and the receiving connector includes a corresponding fifth pin receiver for receiving and electrically coupling to the fifth pin.

25. The system as claimed in claim 24, wherein the outer braided shield is coupled to the connector housing.

26. The system as claimed in claim 25, wherein a capacitor is coupled between the outer shield and the inner shield.

27. The system as claimed in claim 26, wherein the first and second differential pair of conductors have a characteristic impedance of 110 ohms.

28. The system as claimed in claim 26, wherein the first and second differential pair of conductors have a characteristic impedance less than 110 ohms for also transmitting data between non IEEE 1394 devices.

29. An IEEE 1394 system with a quad cable having a length greater than 4.5 meters, the cable comprising:

a. a first pair of differential conductors arranged parallel to each other over a length of the quad cable for carrying differential signals between IEEE 1394 devices; and b. a second pair of differential conductors arranged parallel to each other over the length of the cable for carrying differential signals between IEEE 1394 devices;

wherein, each differential conductor from the first pair of differential conductors are positioned opposite of each other through a center of the cable and each differential conductor from the second pair of differential conductors are positioned opposite of each other through the center of the cable.

30. The IEEE 1394 system of claim 29, wherein the cable comprises a shield structure enclosing the first pair and the second pair of differential conductors over the length of the cable, the shield structure comprising:

a. an inner braided shield;

b. an outer braided shield; and c. a shield separator positioned between the inner braided shield and the outer braided shield for providing electrical separation.

31. The IEEE 1394 s stem of claim 30, further comprising a receiver connector comprising a connector housing, wherein the inner braided shield and the outer braided shield are coupled to ground through the connector housing.

32. The IEEE 1394 system of claim 31, wherein the receiver connector further comprises a capacitor through which the inner braided shield and the outer braided shield are AC coupled.

33. The IEEE 1394 system of claim 30, further comprising receiving pins attached to each differential conductor of the first pair of differential conductors and the second pair of differential conductors for providing a connection of the cable to an IEEE 1394 Serial Bus.

34. The IEEE 1394 system of claim 30, wherein the shield separator comprises aluminum.

35. The IEEE 1394 system of claim 34, wherein the shield separator comprises an aluminum layer.

36. An IEEE 1394 standard compliant cable having a length greater than 4.5 meters comprising:

a. a first pair of wires for carrying a first differential signal, wherein the first pair of wires comprise a wire of a diameter of at least 26 American Wire Gauge;

b. a second pair of wires for carrying a second differential signal, wherein the second pair of wires comprise a wire of a diameter of at least 26 American Wire Gauge;

c. a first internal braided shield formed around the first and the second pair of wires;

d. a second internal braided shield formed around the first internal braided shield;

e. a separator layer between the first and the second internal braided shield; and f. a flame retardant jacket formed around the second internal braided shield.

37. The IEEE 1394 standard compliant cable of claim 36, further comprising a plurality of power conductors for carrying power signals.

38. The IEEE 1394 standard compliant cable of claim 36, wherein at least one of the first pair and the second pair of wires are arranged parallel to each other over the entire length of the cable.

39. The IEEE 1394 standard compliant cable of claim 36, wherein the first pair and the second pair of wires are arranged parallel to each other over the entire length of the cable.

* * * * *